US010662731B2

(12) United States Patent
Spacek

(10) Patent No.: US 10,662,731 B2
(45) Date of Patent: May 26, 2020

(54) ENHANCED BLOWOUT PREVENTER

(71) Applicant: Joe Spacek, Brant Lake, NY (US)

(72) Inventor: Joe Spacek, Brant Lake, NY (US)

( * ) Notice: Subject to any disclaimer, the term of this patent is extended or adjusted under 35 U.S.C. 154(b) by 208 days.

(21) Appl. No.: 15/723,169

(22) Filed: Oct. 3, 2017

(65) Prior Publication Data

US 2018/0216435 A1 Aug. 2, 2018

Related U.S. Application Data

(60) Provisional application No. 62/451,561, filed on Jan. 27, 2017.

(51) Int. Cl.

| | |
|---|---|
| ***E21B 33/064*** | (2006.01) |
| ***E21B 33/06*** | (2006.01) |
| ***E21B 33/038*** | (2006.01) |
| *E21B 19/00* | (2006.01) |
| *E21B 47/09* | (2012.01) |

(52) U.S. Cl.

CPC ..... *E21B 33/064* (2013.01); *E21B 33/038* (2013.01); *E21B 33/063* (2013.01); *E21B 19/002* (2013.01); *E21B 47/09* (2013.01)

(58) Field of Classification Search

CPC ..... E21B 33/038; E21B 33/06; E21B 33/063; E21B 33/064

See application file for complete search history.

(56) References Cited

U.S. PATENT DOCUMENTS

| | | | | |
|---|---|---|---|---|
| 8,579,033 | B1 * | 11/2013 | Robichaux | E21B 33/06 166/351 |
| 8,781,743 | B2 * | 7/2014 | McKay | E21B 41/0007 702/6 |
| 2013/0168578 | A1 * | 7/2013 | Leuchtenberg | E21B 33/06 251/1.3 |
| 2016/0102517 | A1 * | 4/2016 | Ibanez | E21B 33/06 166/250.01 |
| 2017/0314355 | A1 * | 11/2017 | Ferrara | E21B 33/0355 |
| 2018/0187506 | A1 * | 7/2018 | Bhadbhade | E21B 33/0355 |

* cited by examiner

*Primary Examiner* — Ryan A Reis

(57) ABSTRACT

This art creates an Advanced Annular Closing Device (AACD) that corrects significant environmental operational failure modes of the existing/in-use annular closing devices. The art further develops a Mini-AACD that significantly reduces the size of the annular closing mechanism providing improved operational reliability and lower cost. The Mini-AACD is incorporated in a unique Transitory Blowout Controller (TBC) assembly installed within the drilling return/riser pipe providing enhanced and redundant blowout annular closing protection (to the existing BOP).

As options the art further incorporates additional supporting devices to the AACD, Mini-AACD and/or Seabed Drilling Equipment using simplistic and reliable alternative technology that provides redundancy to the overall existing/in-use BOP providing significantly more reliable means to close a well.

15 Claims, 9 Drawing Sheets

Transitory Blowout Controller - Seabed Equipment Interface

Drilling System Equiptment Overview

Transttory Blowout Controller -
with the Seabed Pressure Relief Option

Transitory Blowout Controller - Seabed Equipment Interface

Mini-Advanced Annular Closing Device

Advanced Annular Closing Device

Drill Pipe Cutting Device

Drill Pipe Restricting / Holding Decice

Drill Pipe Turning Device

Drill Pipe Lifting Device

ENHANCED BLOWOUT PREVENTER

BACKGROUND OF THE INVENTION

1. Field of the Invention

The present invention relates to disaster prevention system for offshore oil/gas wells and in particular to an enhanced/improved annular closing device as well as other optional supporting devices that provide the means to insure human, equipment and environmental safety and associated cost avoidance during the offshore well drilling process.

2. Description of Related Art Including Information Disclosed Under 37 CFR 1.97 and 1.98

Shortly after the 2010 offshore oil well catastrophe in the Gulf of Mexico, it became obvious that British Petroleum (BP), the entire oil industry, and/or the US Government were unprepared to effectively stop the gushing oil or the means to clean it up. Throughout the first two plus months of the disaster numerous re-sealing, capturing, clogging, killing and capping techniques were unsuccessfully attempted and several high risk/cost 'normal' well drilling processes were brought to light.

The successful 20 July re-seal, capture and cap 'Rube Goldberg'/'Kluge'(said with admiration) was a simplistic but effective temporary solution for the catastrophic symptoms of the problem—where the primary operative phrase is 'temporary solution for the catastrophic symptoms'.

The enormous somewhat/sometimes unquantifiable costs of the (or of a future) incident includes; human life, environment, drilling platform, well equipment and the associated labor along with the loss of future production, equipment and labor associated with the re-seal, cap, capture & relief/kill wells, sea/gulf clean-up, tourist, fishing industry, local community as well as public opinion relating to the oil industry, the government and the nation & international financial markets The prior art 'blowout preventer' (BOP) is intended to close off the well in case of an uncontrolled/emergency condition (blowout). It's a multi mega-buck, multi-ton, multi-story device installed on the seafloor having various means/methods, with the design intent of closing a well. The most technically difficult challenge is if/when a drill pipe is within the BOP where the BOP must 'ram' through the pipe/pipe joints to close off the well. The second significant technically difficult challenge is to close the flow path around the exterior of the drill pipe. Both seem difficult (at best), but add the extreme water pressure and low temperatures, the extreme oil pressure and high temperatures, the contaminated/particles within the mud and the physical movement (bowing, vibration, etc.) of the drill pipe, the existing BOP is likely not going to work. After the Macondo's well was finally closed, the BOP was pulled up and evaluated—it was functional but did not do the job.

As offshore oil drilling/production continues in the future it seems only rational that the government as well as oil industry itself would demand, as a prime priority the development of improved equipment/systems and processes.

The focus of the 'quick fix' was to stop/control the symptoms of the immediate catastrophe—the gushing oil. What is needed is approach that provides reliable means to reduce/eliminate the causes/impacts of oil/gas well blowouts.

BRIEF SUMMARY OF THE INVENTION

The primary design objective of the invention is to provide reliable, practical and cost effective improvements that reduce/eliminate the causes and/or impacts of blowouts. This specific design focus was to correct operability/reliability issues associated with the existing/in-use annular closing devices. The improved device is identified as an Advanced Annular Closing Device (AACD).

The invention further modifies the AACD by significantly reducing the area of the closing mechanism (and the device's overall physical size). The reduced size AACD is identified as a Mini-AACP. The Mini-AACP is incorporated in a Transitory Blowout Controller (TBC) Assembly added in series with the BOP and installed within the well's return/riser pipe.

Various other (prior & new art) supporting devices are identified to further improve the operational capability. These include a pressure relief and diversion functional assembly (physically located in/on the wells seabed drilling equipment) and several (low cost, highly reliably, alternative technology) devices such as; drill pipe restricting/holding, cutting, turning/un-screwing & lifting devices (physically located in/on the seabed drilling equipment and/or within the TBC).

Considering the pure human and environmental safety, the pure dollar and cents (or multi-million/billion dollar) cost avoidance and/or the potential cost savings/reductions, it is a significant understatement to suggest that features of the present invention should be integrated with other planned improvements, and incorporated on all oil wells.

DETAILED DESCRIPTION OF THE INVENTION

The purpose is to improve the blowout protection operational reliability.

The invention identifies an Advanced Annular Closing Device (AACD) that corrects/fixes environmental operational flaws of the existing/in-use annular closing device.

Specifically the AACD ensures that the sealing area is clear of drilling particles/chips carried in the mud. The invention further defines a Mini-AACD that further improves the operational reliability by incorporating a redesigned/miniaturized closing mechanism that significantly reduces the size of the closing mechanical components.

The Mini-ACCD is incorporated into a unique Transitory Blowout Controller (TBC) assembly that is physically installed within the drilling return/riser pipe, about the drill pipe, between the drill bit and the drill platform/ship.

The TBC housing is tubular, slightly smaller in diameter than the size of the drilling return/riser pipe. The lower end of this housing incorporates the means to mechanically connect/disconnect the device to the existing seabed drilling equipment.

A modification to the drill pipe is incorporated to mechanically support/hold the device during its transition to/from the drill platform/ship to the seabed drilling equipment. The AACD and Mini-AACD are remote-controlled annular mechanical closing device capable of stopping the flow path of liquids/gases between the exterior of the drill pipe and the interior side walls of the seabed equipment (BOP/Adjunctive BOP) or the interior sidewalls of the TBC. The AACD's pass-thru opening is determined by the drill bit size where the Mini-AACD pass-thru opening is designed for the drill pipe size (the pass-thru opening is slightly larger than the specific drill pipe size). The closing mechanism of the Mini-AACD's operational area is significantly less than half that of the AACD or the existing/in-use annular closing device's mechanism.

Options with the AACD and/or Mini-AACD include;

A secondary controlled bypass, bypassing the gasket/seal drill pipe closing area/function. This secondary remote control bypass is incorporated on mechanical nonworking area of the primary (seal/gasket to drill pipe) closing mechanism. This bypassed provides the mud flow path prior to the full gasket to drill pipe closure, allowing a particle filter/screening and/or a liquid gas cleaning/sealing agent to clear/clean the contact surface area. This bypass also provides an additional operational mud flow path for the Mini-AACD, where the Mini-AACD mud flow path is significantly limited by its small opened operational area.

A particle filter/screening element above and/or below the gasket/seal to drill pipe contact area.

Elements that include compressed liquid/gas cleaning/sealing agent, a control valve and related tubing capable of directing the said agent towards the gasket/seal-drill pipe contact surface area.

Options either within the AACD and/or Mini-AACD and/or in/on the Seabed Drilling Equipment include;

A drill pipe restricting/holding controlled device(s).

A drill pipe lifting device.

A drill pipe cutting and/or turning device(s).

A well access gate valve.

The 'Pipe Restricting/Holding Device' is a remotely controlled horizontal drive with pipe guiding/grabbing element(s). The mechanical horizontal drive move the attached pipe guiding/grabbing element(s) horizontally towards the drill pipe wherein the guiding/grabbing elements limit/restrict the drill pipes horizontal motion or holds the drill pipe from any horizontal, vertical or circular motion.

The 'Pipe Lifting Device' is a remotely controlled jawed mechanism that engaging the drill pipe and via a vertical motor drive mechanism provides the means to vertically lift the pipe.

The 'Pipe Cutting Device' is a remotely controlled cutting device that incorporates a horizontal drive controlled element positioning motor driven cutting blade(s) wherein the cutting blades provide the means to sever/separate the pipe.

The 'Pipe Turning Device' is a remotely controlled jawed mechanism that engages and grips the drill pipe and mechanically turns the pipe—unscrewing it from a different pipe section the holding device is gripping.

The pipe cutting and/or pipe turning devices could also include a pipe joint sensing device. This device could insure the pipe turning device and the pipe holding device are positioned on different pipe sections and/or the pipe cutting device is not attempting to cut through a pipe joint (either function would be supported by feedback/control of the pipe lifting device).

The 'Well Access Gate Valve' is a large (opening capable of passing a drill bit), remote controlled valve that provides the means to close off the entire well access area, when there are no obstructions (the drill pipes is cleared—cut/unscrewing and drops, lifted or removed by the drill platform or ROV).

Options associated with the AACD and/or Mini-AACD incorporated in/on the Seabed Drilling Equipment include;

A pressure relief, diversion device.

A capture & recovery subsystem connected to the pressure relief, diversion device.

An antifreeze/dispersant/coagulant functional assembly compatible with mixing agents with the pressure relieved oil/gas.

The Pressure Relief, Diversion Device incorporates a three (or more port) manifold where two ports are in line/in series with the wellbore and are compatible with passing through a drill bit and wherein a third port includes a remotely controlled valve connected to a diversion tube/pipe. This functional element provides the means to relieve pressure during transition periods by either dumping the oil into the environment or to a capture and recovery subsystem. This function may be further enhanced by the incorporation of an additional port and valve wherein antifreeze/dispersant/coagulant agent could be mixed with pressure relieved oil/gas.

Note: Activating/closing the well Access Gate Valve would typically require 1-2 minutes to accomplish (to cut/un-screw and clear the drill pipe). It is assume during this interim period a pressure relief manifold would be activated allowing the blowout oil/gas a low resistance path to the environment or to a capture & recovery subsystem.

All of the active operational devices are powered by either self-contained batteries and/or internal or external power sources (electrical/hydraulic) from either the seabed drilling equipment and/or the surface drilling platform/ship, or combinations of the said. When powered from external sources, appropriate connection devices are incorporated.

Controls (such as activation/deactivation) and any signals (such as status) would be provided by electrical/electronic, fiber-optic and/or acoustics means. Such controls/signals would include appropriate connection devices.

TBC Installation Process a) Prior to installing/changing the drill bit, select a proper sized TBC (drill pipe size) and install the TBC about drill pipe.

b) Install/activate the TBC drill pipe supporting/holding/securing element(s) on the drill pipe between the drill bit & the TBC.

c) Install the drill bit.

d) Lower the drill pipe (and the TBC) to the drilling seabed equipment.

e) Secure the TBC to the drilling seabed equipment.

f) Proceed with normal drilling operations.

Operation Process

A major kick/possible blowout is sensed.

a) Stop and stall the mud pump and close the mud pit (to hold the mud in a drill pipe and in the drill return/riser pipe via vacuum action).

b) Open the pressure relief gate valve.

c) Activate (open) the secondary (bypass) annular closing mechanism.

d) Activate the pipe holding device.

e) Activate the sealing/cleaning (gasket to drill pipe) cleaning agent.

f) Activate the primary (gasket to drill pipe) annular closing mechanism.

g) Activate (close) the secondary (bypass) annular closing mechanism.

h) Check the well status (pressure in well, pressure and flow in diversion path, etc.).

Try stuff as appropriate/as the conditions allow (heavier mud, allow pressure to bleed off, etc.).

If a blowout conditions continue:

a) De-activate the pipe holding device b) Lift the drill pipe.

c) Activate the pipe holding device.

d) Cut or unscrew (as appropriate) the drill pipe.

e) De-activate the pipe holding device (letting the pipe drop).

f) Close the well access gate valve.

g) Close the pressure relief valve.

h) Continue to monitor the in-well conditions.

Next options (as appropriate):

a) Open the pressure relief valve for some appropriate time.

b) Re-enter the well through drill pipe (with smaller drill/kill pipe) and fix (re-cement) or kill the well.

c) Remove (fish-out) the drill pipe & drill bit and fix (re-cement) or kill the well.

BRIEF DESCRIPTION OF THE SEVERAL VIEWS OF THE DRAWINGS

These and other details of the present invention will be described in connection with the accompanying drawings, which are furnished only by way of illustration and not intended to limit the invention.

The drawings are intended to provide an introductory overview of the major device/elements that are more comprehensively defined in the detailed description of the invention.

Failure 2 is a diagrammatic cross-sectional functional overview of the Transitory Blowout Controller with the Seabed Pressure Relief option.

Figure 1:
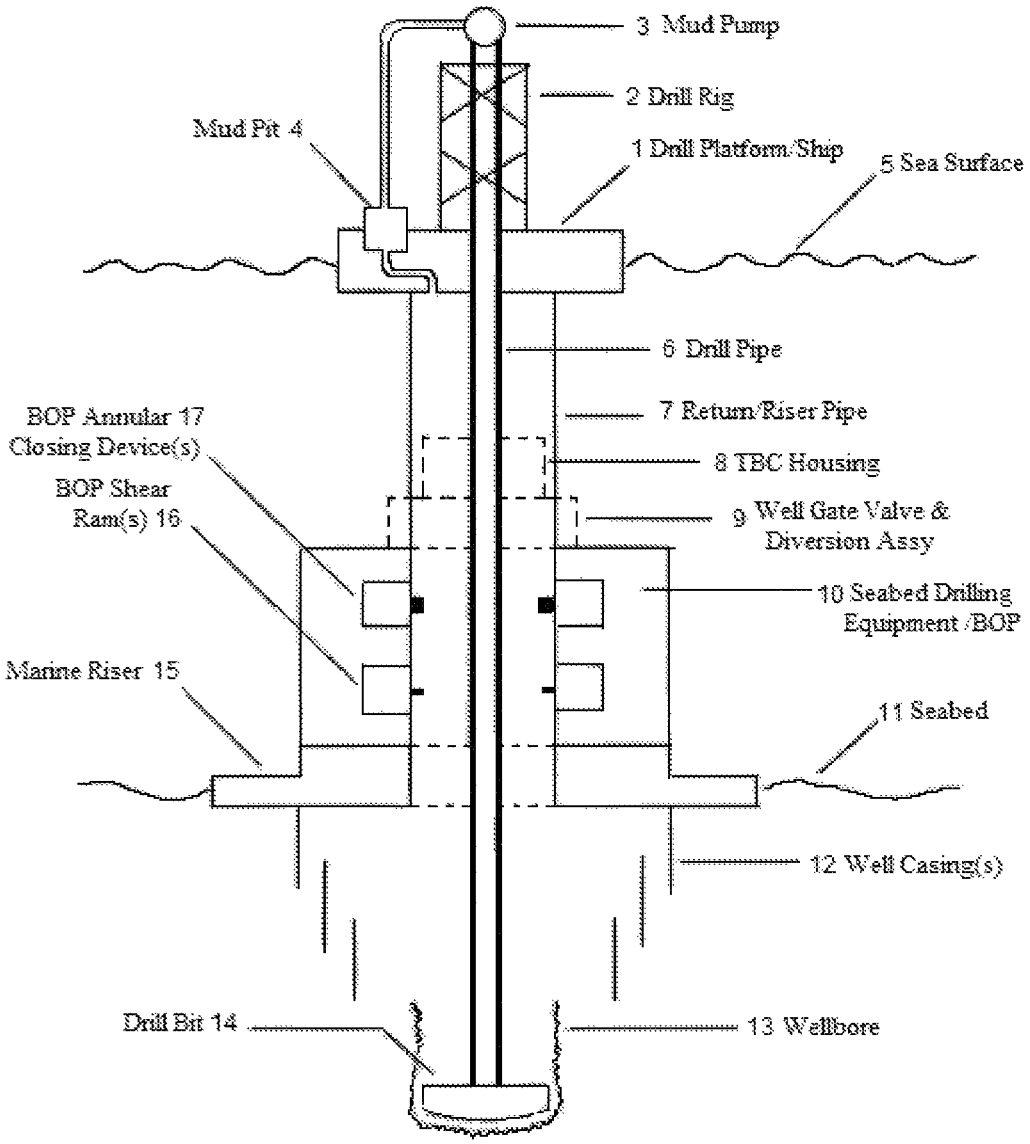
FIG. 1 is a diagrammatic cross-sectional overview of a typical overall offshore drilling systems equipment, primarily intended to depict the relative location of the various devices. Depicted is (1) the Drill Platform/Ship, (2) the Drill Rig, (3) the Mud Pump, (4) the Mud Pit, (5) the Sea Surface, (6) the Drill Pipe, (7) the Drill Return/Riser Pipe, (8) the TBC Housing (internal devices include a Mini-AACD & various optional devices), (9) depicts an optional Well Gate Valve & a Three/Four Port Manifold Diversion Assembly, (10) the Seabed Drilling Equipment/BOP, (11) the Seabed, (12) the installed Well Casing—three shown typically there are more, (13) the Wellbore, (14) the Drill Bit, (15) the Marine Riser, (16) a BOP Shear Ram—one shown typically there are more and (17) existing/in-use Annular Closing Device and/or an AACD [with options such as; pipe restricting, holding, turning, cutting & joint sensing devices)—one device shown typically there are more.

Re-depicted from FIG. 1 is (8) the Transitory Blowout Controller's Housing, (10) the Seabed Drilling Equipment, (6) the Drill Pipe and (7) Drill Return/Return Pipe. Newly depicted is (21), the Mini-Advanced Annular Closing Device, (22) the Drill Pipe Restricting, Holding and/or Lifting Device(s), (23) the Pipe Cutting and/or the Pipe Turning (pipe joint un-screwing) Device(s) along with the Joint Sensing Device, (24) the Well Access Gate Valve, (24') depicts the relative Drill Bit Size of (14), (25) the Pressure Manifold & Relief Control Valve, (26) the Diversion Tube/Pipe, (27) the Anti-Freeze, Coagulant/Dispersant Pressure Relief Manifold & Control Valve and (28) the Anti-Freeze, Coagulant/Dispersant Holding Tank.

It is noted that:

Items (22)-(24) are options that could be incorporated in/on the Seabed Equipment.

Items (25)-(28) are options incorporated in/on the Seabed Equipment.

Figure 3:
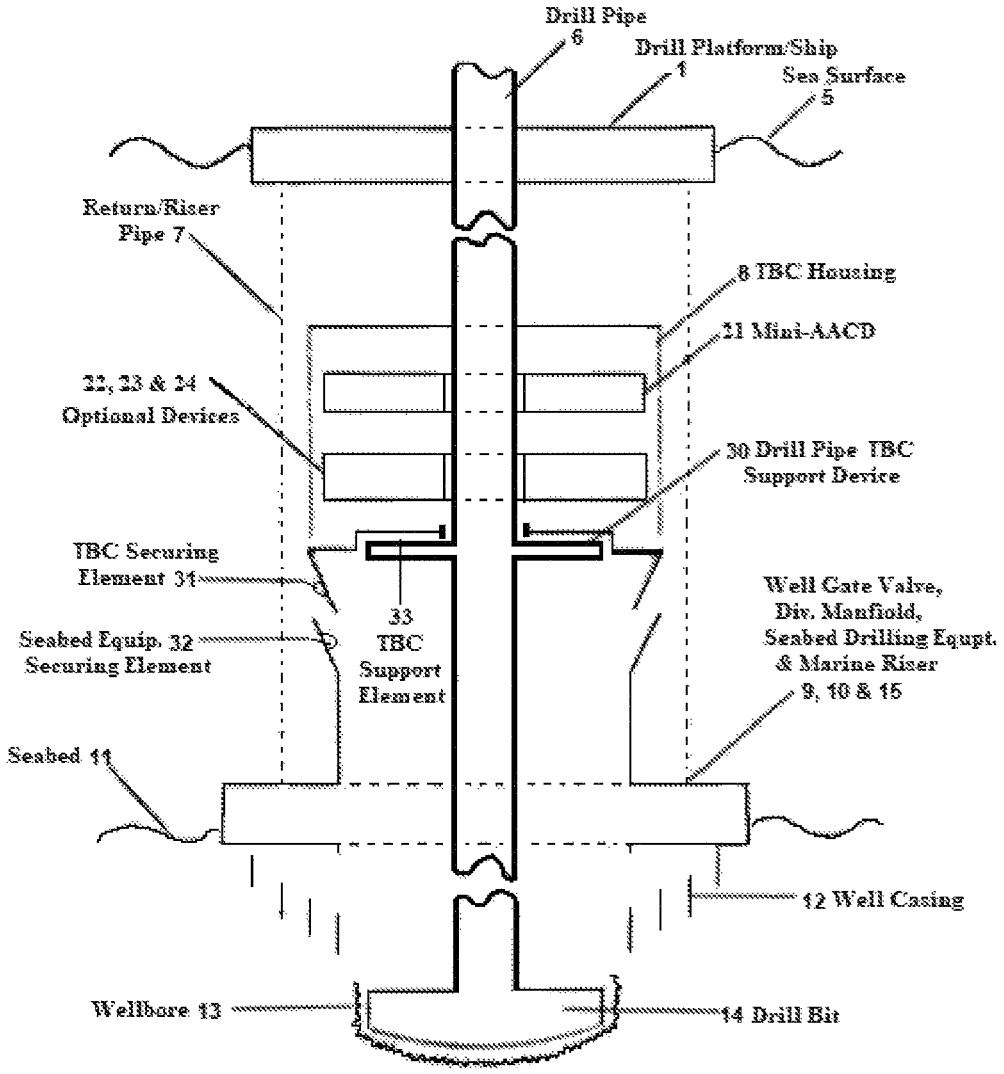

FIG. 3 is a diagrammatic cross-section overview of the Transitory Blowout Controller-Seabed Drilling Equipment Interface.

Re-depicted from FIG. 1 is (1) the Drill Platform/Ship, (6) the Drill Pipe, (5) the Sea Surface, (7) the Return/Riser Pipe, (8) the TBC Housing, (11) the Seabed, (9) (10) & (15) the Well Gate Valve & Manifold/Diversion Assembly, the Seabed Drilling Equipment/BOP and the Marine Riser, (12) the Installed Well Casings, (14) the Drill Bit and (13) the Wellbore.

Figure 2:
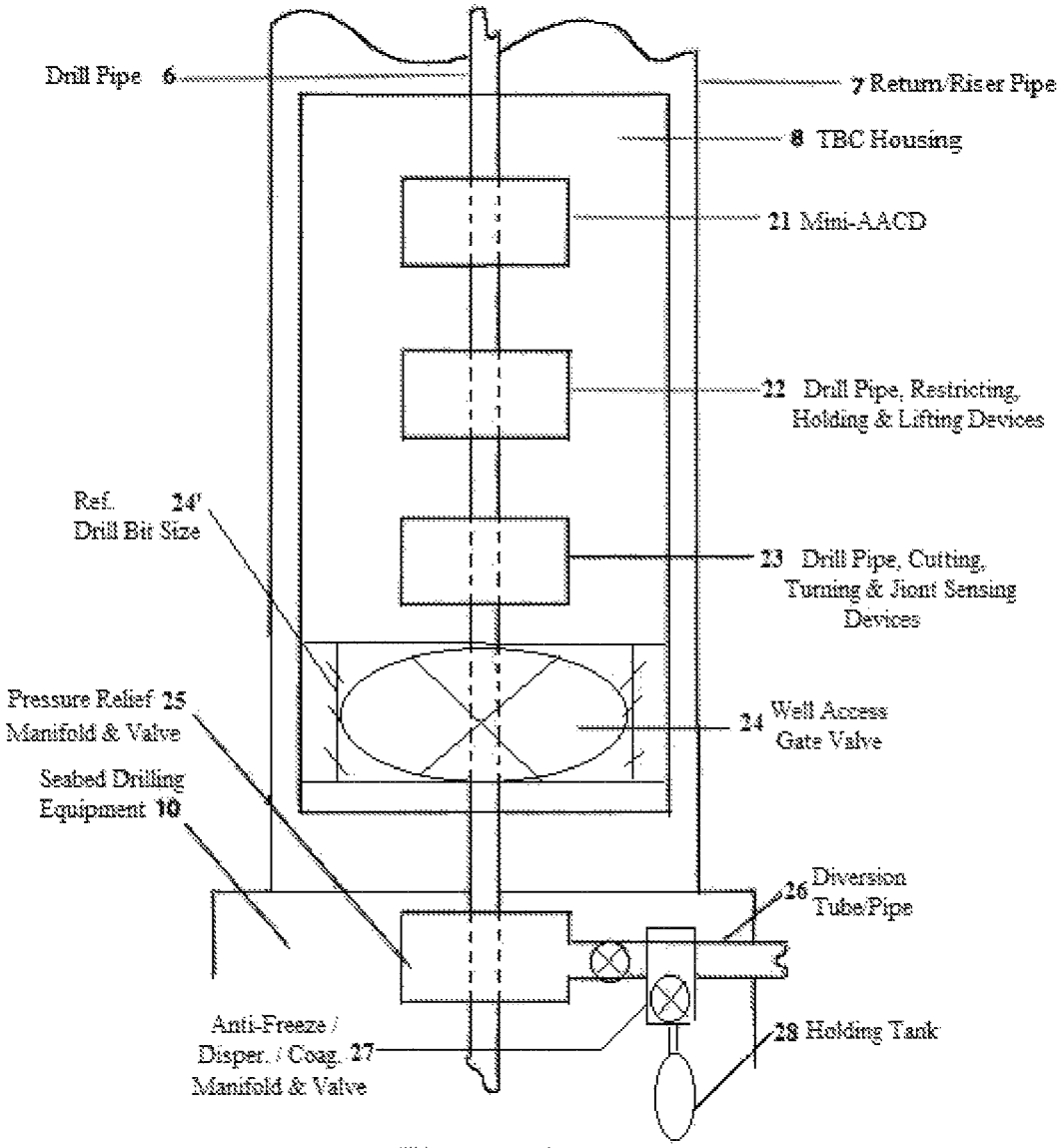

Re-depicted from FIG. 2 is (21) the mini-AACD device, (22) (23) & (24) the Drill Pipe Restricting, Holding, Joint Sensing, Lifting, Cutting and/or Turning Device(s) and the Well Access Gate Valve.

Newly depicted on this Figure is (30) the Drill Pipe TBC Supporting Device and (31) & (32) the TBC's and Seabed's Drilling Equipment's Mechanical Securing Elements and (33) the TBC's Supporting/Interface Elements compatible with the Drill Pipe's TBC Supporting Device.

It is noted that the details of the various configurations of the mechanical coupling elements of (31) & (32) are not depicted. These configurations include but are not limited to pipe threads, snap fitting's (similar to common air compressor hose type fittings modified whereby the drill pipe supporting (30) element would physically engage/disengage the connecting mechanism and/or an electromechanical solenoid device.

Figure 4A:
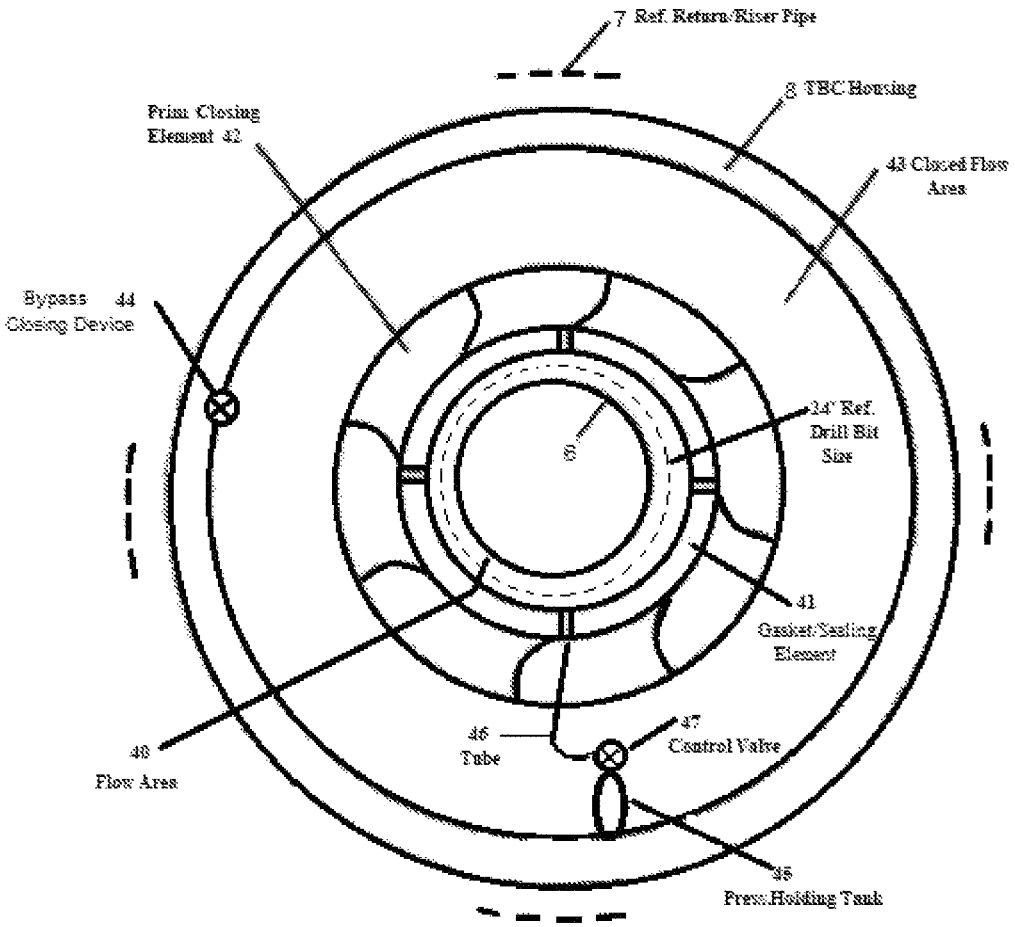

FIG. 4A is a diagrammatic top cross-section view of the Mini-Advanced Annular Closing Device (Mini-AACD).

Re-depicted from FIGS. 1 and or 2 is (7) the Return/Riser Pipe, (8) the TBC Housing, (6) the Drill Pipe and (24') referencing the Drill Bit size. Newly depicted on this Figure is Item (40) representing the operational flow opening for a de-activated annular closing device—typically this opening would be ½" to 2" for the mini-AACD (and significantly greater for the AACD—where the opening must be large enough to pass the drill bit—depicted in FIG. 5B). Item (41) represents the Gasket/Sealing Element, (42) the Primary Mechanical Closing Element—although numerous mechanical devices could be employed, the figure attempts to depict mechanism as a camera type iris closing device, (43) the Closed Flow Area between (8) & (42) and (44) depicts a Bypass/Secondary Closing Element—this bypass element is depicted as a separate functional item (a valve), it is assumed that the functionality of this device could be incorporated within the primary closing device (item 42). Item (45) depicts a Pressurized Holding Tank holding a liquid/gas sealing/cleaning agent, (46) shows one of many tubes directing the cleaning agent towards Drill Pipe to Gasket/Sealing area and (47) depicts the cleaning agent control valve.

It is noted that the Particle Filter/Screening Element is not depicted. This element would be physically secured/connected to either (42) or (43) and its other end would be in contact with the drill pipe (6) prior to the full (gasket to drill pipe) closure.

Figure 4B:
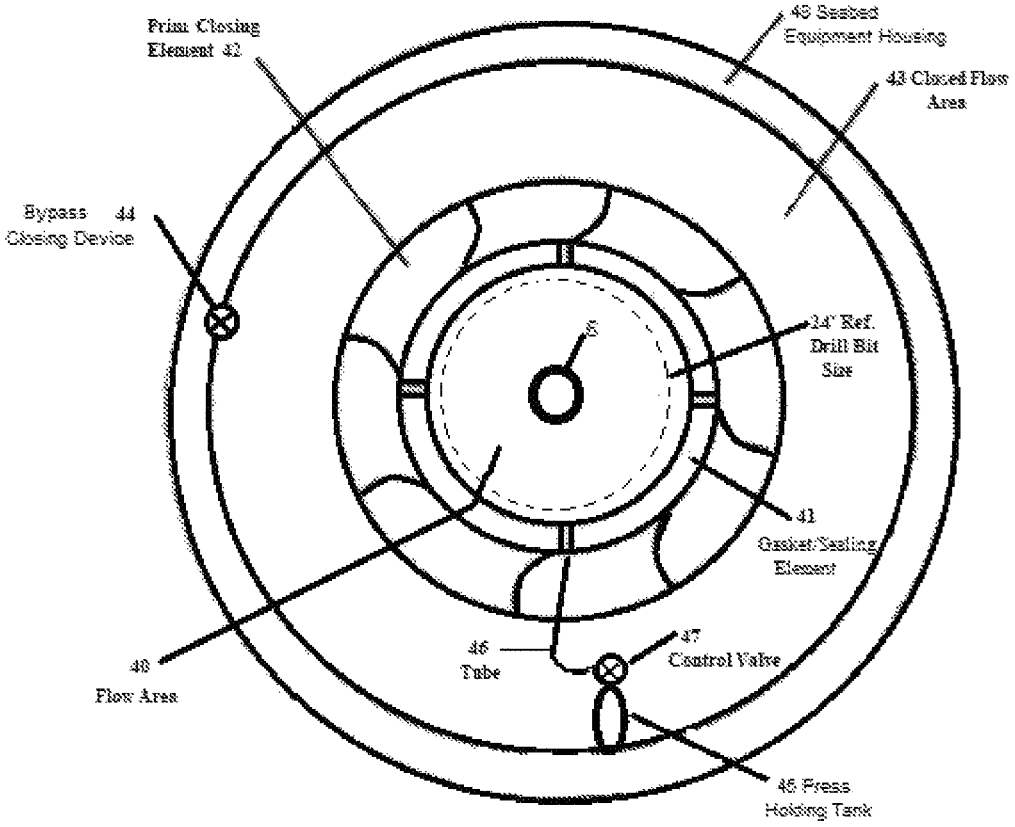

FIG. 4B is a diagrammatic top cross-section view of the Advanced Annular Closing Device (AACD). The device's mechanism is similar in all aspects to those depicted on FIG. 4A. FIG. 4B modifies FIG. 4A changing; item (8) TBC Housing to item (48) the Seabed Equipment Housing (typically the BOP or adjunctive BOP), eliminating the reference to the Riser/Return Pipe (7) and depicts the relative size of the Drill Pipe (6)—with respect to the drill bit size (24').

Figure 5A:
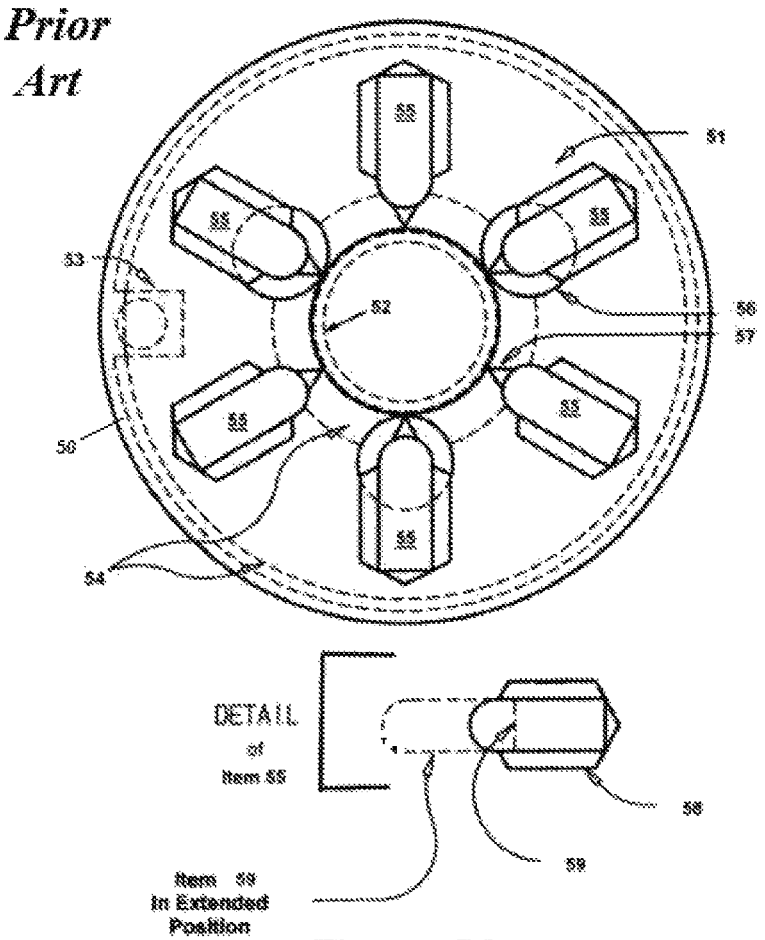

FIG. 5A is diagrammatic cross-sectional top view, depicting the mechanical aspects of a Drill Pipe Cutting Device. Item 50 represents the unit's housing. Item 51 is a flat circular/donut shaped turn-table connected to the units housing via ball bearings. Item 52 (in dashed lines) reference the access area depicting the required centered opening of item 51—slightly larger than the drill pipe for the Mini-AACD & slightly larger than the drill bit for the AACD. Item 53 represents an extension of the units housing and a turntable motor attached to the unit's housing. The motor shaft, gearing & encoder interface with the turn-table. Item 54 (in dashed lines) represents the unit's housing under the turntable. Item 55's are six Lateral Drive Devices.

Items 56 are three circular saw blades each including a high speed motor & tachometer. Items 57*s* are wedges. Items 58 & 59 are details of items 55. Item 58 is the fixed member of item 55. It is affixed to the turn-table and includes a lateral drive motor, an encoder, slides & gearing. Item 59 is the lateral sliding member of item 55 and includes slides & gearing. The dashed lines at item 59 indicate this member at its extended position.

It is noted that:

The turning elements of this drill pipe cutting device (turntable, ball bearings, motors) would not be functionally necessary if a Drill Pipe Turning Device (previously identified as an option & depicted on FIG. 5C) was incorporated elsewhere, and The anti-pinch elements of this drill pipe cutting device (wages and associated drives) would not be functionally necessary if a drill Pipe Lifting Device (previously identified as an option & depicted on FIG. 5D) was Incorporated elsewhere.

The sequence of operations of the Pipe Cutter Mechanism is enabled by an operator. In an automatic operational mode, after being embedded a micro-processor and associated program controls the operation.

In a manual mode the operator will perform the steps below:

1. The operator will initiate a pipe cut.
2. The Circular Saws and Lateral Drive Devices drives, with minimum torque contacts the pipe.
3. The saw motors are turned on and laterally driven into the pipe until either the thickness of the pipe-wall is penetrated or the saw motor speed decreases greater than 20%. If the latter occurs see * (below).
4. When three saws have penetrated the pipe, the Lateral Drive Devices retract the saw blades.
5. The Turn-Table is moved/re-positioned 120 degrees.
6. The Wedges' Lateral Drive Devices is activated pressing the wedges into the pipe cut.
7. The Circular Saws' Lateral Drive Devices is again activated to drive the saw blade towards the pipe until either the thickness of the pipe wall is penetrated and the pipe is fully cut or the saw motor speed decreases greater than 20%. If the latter occurs see * (below).
8. Once the pipe is fully cut it must be extracted.

* If any of the saws speed decreases greater than 20% from its unloaded speed, the appropriate drives will be backed-off until the no-load speed is obtained. The drives will then proceed to the continuing cutting process.

Figure 5B:
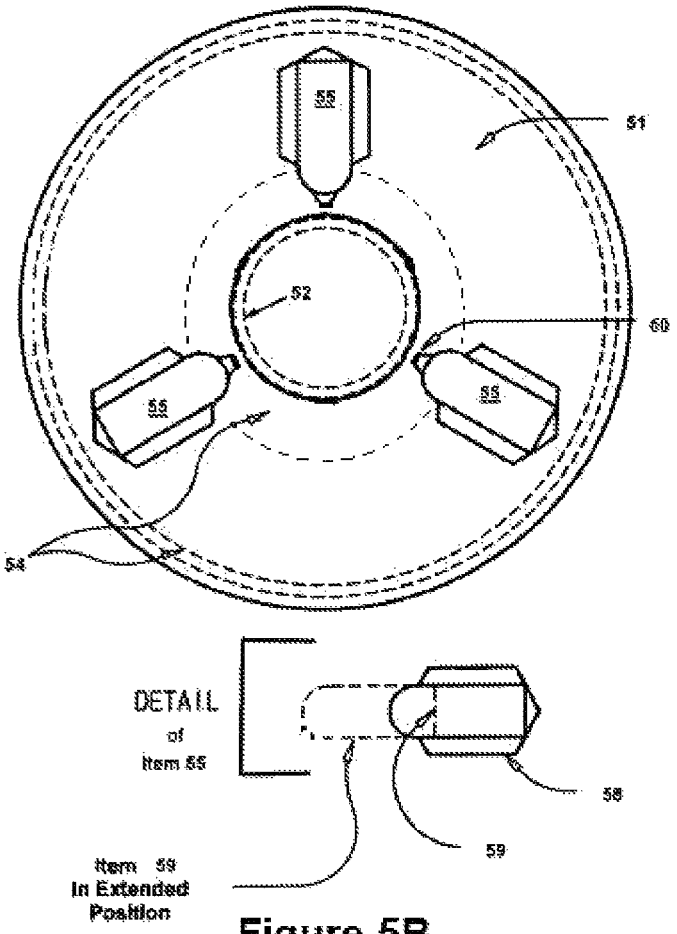

FIG. 5B is diagrammatic cross-sectional top view, depicting the mechanical aspects of a Drill Pipe Restricting/Holding Device. The mechanism and operation is similar to those depicted on FIG. 5A with the following exceptions; the turning elements of this Drill Pipe Cutting Devices Item's 51 & 53 (turntable, ball bearings & related motor) would not be functionally necessary—Item 51 would instead be attached to the housing structure. The three circular saw blades each include a high speed motor (56) and their three associated horizontal drive units (55) and three wedge elements (57) are replaced by three restricting/holding elements (60). For the holding functional device item 60 incorporates a drill pipe gripping/grabbing surface area. For the restricting functional device item 60 may incorporates a drill pipe gripping/grabbing surface area or a smooth hardened metal surface. Item 60 would be driven (by horizontal drive units)—close to the drill pipe for the restricting mode of operation and into sidewall of the drill pipe for the holding operation.

Figure 5C:
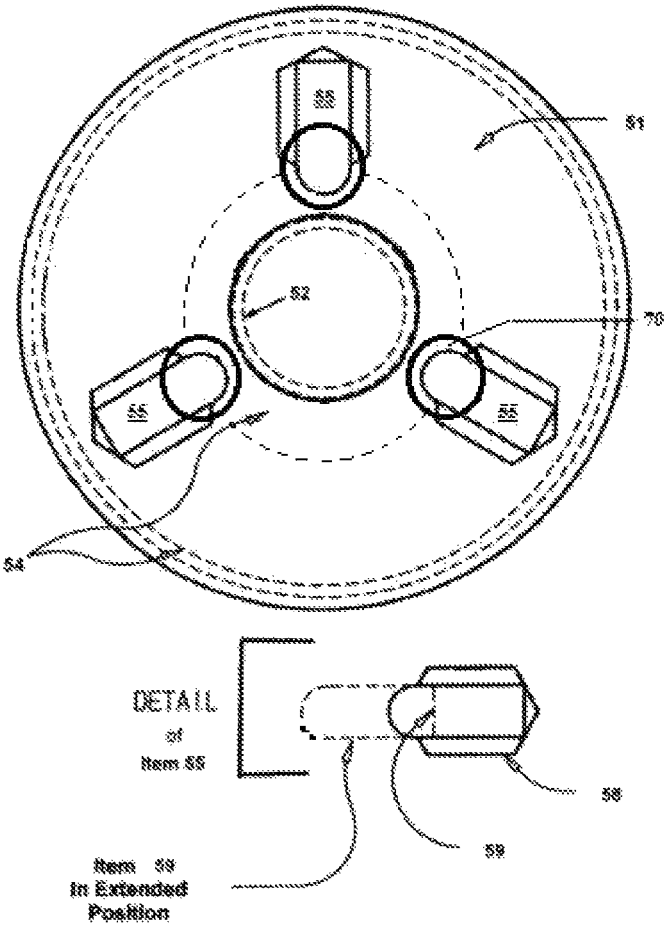

FIG. 5C is diagrammatic cross-sectional top view, depicting the mechanical aspects of a Drill Pipe Turning Device. The mechanism and operation is similar to those depicted on FIG. 5B with the exception that Items 60 elements are replaced by low-speed/high torque (70) motors and associated gearing wherein the circular gear depicted on figure incorporates a drill pipe gripping/grabbing surface area.

Figure 5D:
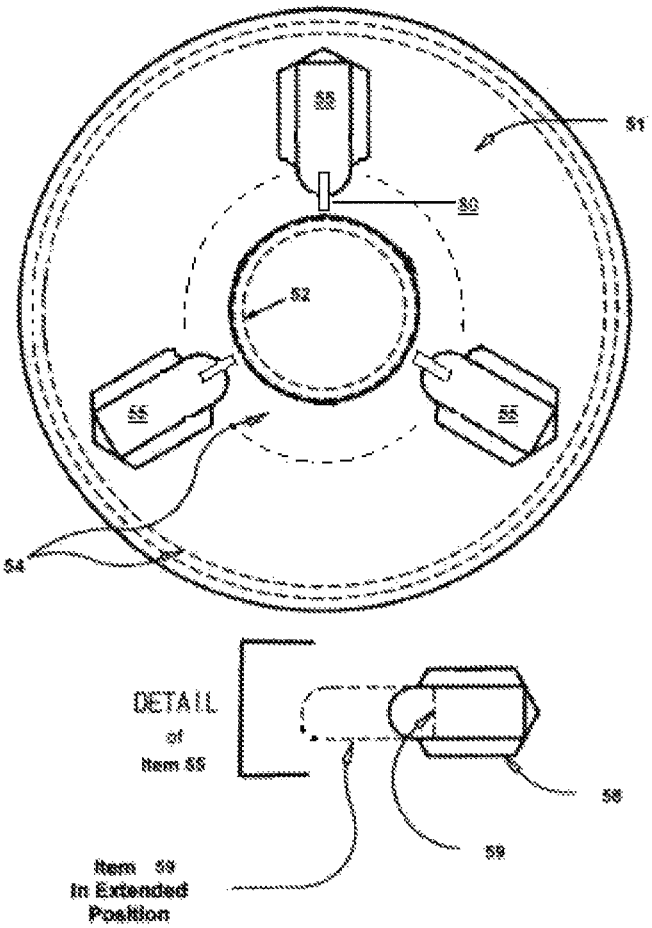

FIG. 5D is diagrammatic cross-sectional top view, depicting the mechanical aspects of a Drill Pipe Lifting Device. The mechanism and operation is similar to those depicted on FIG. 5C with the exception that Items 70 elements (low-speed/high torque motors and associated gearing wherein the circular gear depicted on figure incorporates a drill pipe gripping/grabbing surface area) are replaced by Item 80, where item 80 physically replaces Items 70, where Item 80 rotational access is offset 90°.

What is claimed is:

1. An Advanced Annular Closing Device (AACD) wherein the AACD incorporates an electrical or hydraulic annular mechanical closing element, a pressurized cylinder containing a compressed liquid/gas cleaning/sealing agent, a control valve and tubing, wherein the annular mechanical closing element is composed of an immobile housing component and a mobile component, wherein the mobile component further incorporates a gasket/sealing component, wherein when activated the mobile component of the annular mechanical closing element physically obstructs the flow path of liquids/gases between the AACD and an existing drill pipe, wherein during the closing process the control valve releases the compressed cleaning/sealing agent from the pressurized cylinder, wherein the cleaning/sealing agent is directed towards the gasket/sealing component at the drill pipe area by the tubing.

2. The AACD of claim 1 further incorporating a liquid/gas bypass control device composed of a tube/pipe and a controlled valve wherein the liquid/gas bypass control device is installed between the gasket/sealing component and the immobile housing component of the annular mechanical closing element, wherein when the controlled valve component is activated or deactivated the liquid/gas bypass control device provides an independent liquid/gas flow path.

3. The AACD of claim 1, further incorporating a particle filtering/screening element above or below the gasket/sealing component.

4. A Transitory Blowout Controller Housing/Assembly (TBC) wherein the interior of the TBC assembly incorporates a Mini-Advanced Annular Closing Device (Mini-AACD), wherein the Mini-AACD is composed of an immobile housing component and a mobile component, wherein the Mini-AACD incorporates an electrical or hydraulic annular mechanical dosing element, wherein the mobile component further incorporates a gasket/sealing component, wherein a de-activated center opening of the Mini-AACD is slightly larger than the diameter of an existing drill pipe, wherein the slightly larger diameter is defined as one half inch to six inches larger than the drill pipe, wherein when activated the Mini-AACD physically obstructs the flow path of liquids/gases between the Mini-AACD and the drill pipe, wherein the TBC is installed within an existing drilling platform to an existing Blowout Preventer (BOP) return/riser pipe and transitions within this return/riser pipe to/from the existing drilling platform to the existing BOP by the existing drill pipe, wherein the TBC incorporates a mechanical connecting/securing element to the BOP, wherein the BOP is modified to incorporate a compatible mating element to the TBC's connecting element, wherein the existing drill pipe is modified to incorporate a TBC supporting element, wherein the TBC incorporates a structural element that mechanically interfaces with the drill pipe's supporting element, wherein the drill pipe supporting element holds/supports the TBC during its transition to/from the drilling platform to the BOP and further mechanically controls/supports the TBC as it is connected/de-connected from the BOP.

5. The TBC of claim 4 wherein the Mini-AACD further incorporates a pressurized cylinder containing a compressed liquid/gas cleaning/sealing agent, a control valve and tubing, wherein during the closing process the control valve releases the cleaning/sealing agent from the pressurized cylinder wherein the cleaning/sealing agent is directed towards the seal/gasket at the drill pipe by the tubing.

6. The TBC of claim 4 wherein the Mini-AACD further incorporates a liquid/gas bypass control device composed of a tube/pipe and a controlled valve component wherein the liquid/gas bypass control device is installed between the gasket/sealing component and the immobile housing component of the Mini-AACD, wherein when the controlled valve component is activated or deactivated the liquid/gas bypass control device provides an independent liquid/gas flow path.

7. The TBC of claim 4 wherein the Mini-AACD further incorporates a particle filtering/screening element above or below the gasket/seal component.

8. The TBC of claim 4 further incorporating a drill pipe restricting/holding device wherein the drill pipe restricting/holding device incorporates an electrical or hydraulic mechanical horizontal drive element and an pipe guiding/grabbing element, wherein the pipe guiding/grabbing element is mechanically attached to a movable component of the mechanical horizontal drive element, wherein a non-movable component of the mechanical horizontal drive element is mechanically attached to the TBC, wherein when activated the mechanical horizontal drive element moves the attached pipe guiding/grabbing element horizontally towards the drill pipe wherein the guiding/grabbing element limits or restricts the drill pipe from horizontal, vertical or circular motion.

9. The TBC of claim 4 further incorporating a drill pipe turning assembly wherein the drill pipe turning assembly incorporates an electrical or hydraulic mechanical horizontal drive element and a circular drive element, wherein a non-movable component of the mechanical horizontal drive element is mechanically attached to the TBC, wherein the circular drive element is mechanically attached to a movable component of the mechanical horizontal drive element, wherein the circular drive element includes an attached horizontal circular geared component, wherein the circumference of the circular geared component incorporates a geared/high friction pipe grabbing surface compatible with physically engaging and mechanically turning the drill pipe.

10. The TBC of claim 4 further incorporating a drill pipe lifting assembly wherein the drill pipe lifting assembly incorporates an electrical or hydraulic mechanical horizontal drive element and a circular drive element, wherein a non-movable component of the mechanical horizontal drive element is mechanically attached to the TBC, wherein the circular drive element is mechanically attached to a movable component of the mechanical horizontal drive element, wherein the circular drive element includes an attached vertical circular geared component, wherein the circumference of the circular geared component incorporates a geared/high friction pipe grabbing surface compatible with physically engaging and mechanically lifting the drill pipe.

11. The TBC of claim 4 further incorporating a drill pipe cutting device either within the TBC's housing or in/on the BOP.

12. The TBC of claim 4 further incorporating a pipe joint sensor device either within the TBC's housing or in/on the BOP.

13. The TBC of claim 4 further incorporating a gate valve device that restricts the flow of gas/oil in the entire existing drilling platform to BOP return/riser pipe.

14. The TBC of claim 4 further incorporating a three or more port manifold physically installed below the TBC assembly wherein two ports are in-line/in-series with existing drilling platform to BOP return/riser pipe and wherein a third port includes a remotely controlled valve, wherein the remotely controlled valve is connected to a diversion tube/pipe.

15. The TBC of claim 14 further utilizing an additional manifold port or an additional manifold, wherein this additional port is connected to a controlled valve that is connected to an antifreeze/dispersant/coagulating agent.

* * * * *